United States Patent [19]

Marshall

[11] Patent Number: 4,459,803

[45] Date of Patent: Jul. 17, 1984

[54] VARIABLE INLET VANE ASSEMBLY FOR A GAS TURBINE COMBUSTION

[75] Inventor: Charles Marshall, Stuart, Fla.

[73] Assignee: The United States of America as represented by the Secretary of the Air Force, Washington, D.C.

[21] Appl. No.: 350,493

[22] Filed: Feb. 19, 1982

[51] Int. Cl.[3] ..... F02C 9/00; F02C 7/20

[52] U.S. Cl. ..... 60/39.23; 60/39.32

[58] Field of Search ..... 60/39.23, 39.29, 39.36, 60/726, 39.32; 415/210, 211, 164, 165

[56] References Cited

U.S. PATENT DOCUMENTS

| | | | |
|---|---|---|---|
| 2,227,666 | 1/1941 | Noack | 60/39.23 |
| 2,350,839 | 6/1944 | Szydlowski | 415/164 |
| 3,078,672 | 2/1963 | Meurer | 60/39.23 |
| 3,577,878 | 3/1971 | Greenwood et al. | 60/39.23 |
| 4,054,028 | 10/1977 | Kawaguchi | 60/39.23 |

FOREIGN PATENT DOCUMENTS

| | | | |
|---|---|---|---|
| 1385903 | 3/1975 | United Kingdom | 60/39.23 |

*Primary Examiner*—Carlton R. Croyle
*Assistant Examiner*—Jeffrey A. Simenauer
*Attorney, Agent, or Firm*—Donald J. Singer; Jacob N. Erlich

[57] ABSTRACT

A variable inlet vane assembly for use within the inlet area of a combustor, the vane assembly having a plurality of rotatable vanes situated within an annular-shaped opening in the inlet area of the combustor. Each vane is operated by the rotation of a crank assembly and actuator. The actuator meshes with the crank assembly through a sliding interface in order to accommodate axial and/or radial growth of the combustor with no loss in the precision of the control of air entering the combustor during rotation of the vanes. Such an arrangement substantially enhances the relight capability of the combustor.

5 Claims, 4 Drawing Figures

FIG 2
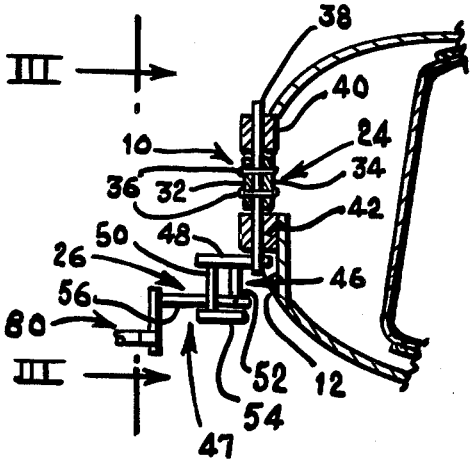
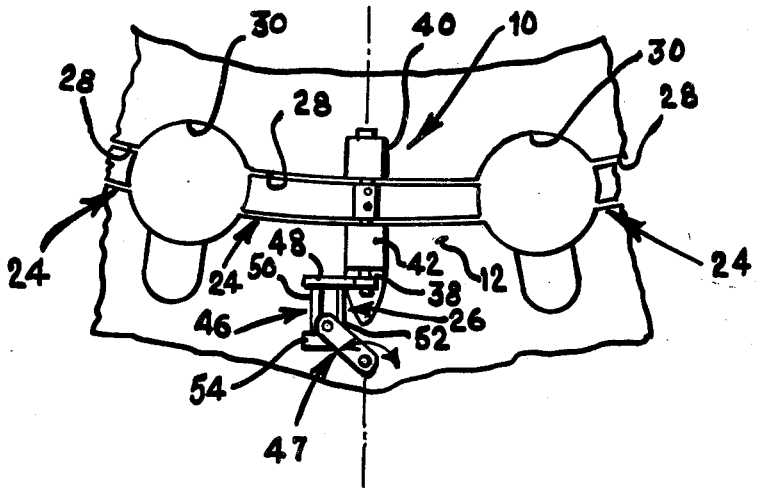
FIG .3

VARIABLE INLET VANE ASSEMBLY FOR A GAS TURBINE COMBUSTION

STATEMENT OF GOVERNMENT INTEREST

The invention described herein may be manufactured and used by or for the Government for governmental purposes without the payment of any royalty thereon.

BACKGROUND OF THE INVENTION

This invention relates generally to high temperture-rise combustors, and, more particularly, to a variable inlet vane assembly for use with such combustors in order to significantly improve the relight capability of the combustor.

It is essential in the operation of high temperture-rise combustors within gas turbine engines to provide control of the incoming air flow into the combustor. Such control is extremely critical when dealing with the relight capability of the combustor. Past cowl inlet area control systems were generally lacking under ground start, altitude relight, idle and maximum power efficiency conditions of the combustor. In addition, problems arose in such systems due to both the axial and radial thermal growth of the combustor during operation. Past systems, for example, were subject to binding as the result of this axial and radial thermal growth.

It is therefore clearly evident that an improved inlet area control system for high temperature-rise combustors would be highly desirable.

SUMMARY OF THE INVENTION

The present invention overcomes the problems encountered in the past and as set forth in detail hereinabove by providing a variable inlet vane assembly which is capable of being readily attached to a combustor cowl inlet, thus regulating the flow of air into the combustor zone.

The variable inlet vane assembly of this invention is designed to be incorporated within the cowl inlet area of a combustor and is made up of a plurality of vanes, each being attached to the combustor cowl through a rotatable shaft and located between adjacent fuel nozzle inlets. The vanes each rotate with a shaft which is positioned slightly off-center with respect to the vane. This off-center location generates an aerodynamic load on the vane, thus minimizing vane flutter as the vanes are rotated. In addition, this feature reduces wear on the bearing surfaces of the vane support shaft.

Each outboard end of a vane shaft attaches to a crank mechanism that engages an actuator. Depending on the desired direction of rotation, the actuator presses against one of a pair of connecting pins on the crank mechanism and thus moves the vanes. The unique design of the crank mechanism allows for thermal growth of the combustor to take place without interfering with the operation or rotation of the vanes since the actuator can move relative to the crank mechanism in both radial and axial directions. Rotation of the vanes during all conditions can occur because the vane moment arm remains constant at all operating conditions, except for a small amount of thermal growth.

An external synchronizing ring is operably connected to the actuator and synchronizes movement of all the vanes. Any suitable power source in the form of, for example, an air cylinder provides the desired force necessary to rotate the vanes into two distinct positions. Indication of the amount of rotation can be provided electrically with limit switches or visually with fiber optic techniques which view directly the vanes as they rotate. By appropriate control of the synchronizing ring, movement of the vanes which are attached to the combustor cowl inlet regulates the flow of air into the combustor zone.

It is therefore an object of this invention to provide a variable inlet vane assembly for use with a gas turbine combustor and which is capable of substantially improving the relight capability of the combustor.

It is another object of this invention to provide a variable inlet vane assembly which is simple in construction and operation and therefore substantially improves system reliability and safety.

It is another object of this invention to provide a variable inlet vane assembly which is capable of accommodating both axial and radial thermal growth of the combustor.

It is still another object of this invention to provide a variable inlet vane assembly which is economical to produce and which utilizes conventional, currently available components that lend themselves to standard mass producing manufacturing techniques.

For a better understanding of the present invention, together with other and further objects thereof, reference is made to the following description taken in conjunction with the accompanying drawing and its scope will be pointed out in the appended claims.

DETAILED DESCRIPTION OF THE DRAWING

FIG. 2 is a side elevational view which shows in particular the variable inlet vane assembly of this invention partly in cross section;

FIG. 3 is a front view of a segment of the variable inlet vane assembly of this invention taken along line III—III of FIG. 2.

DETAILED DESCRIPTION OF THE PREFERRED EMBODIMENT

Figure 1:
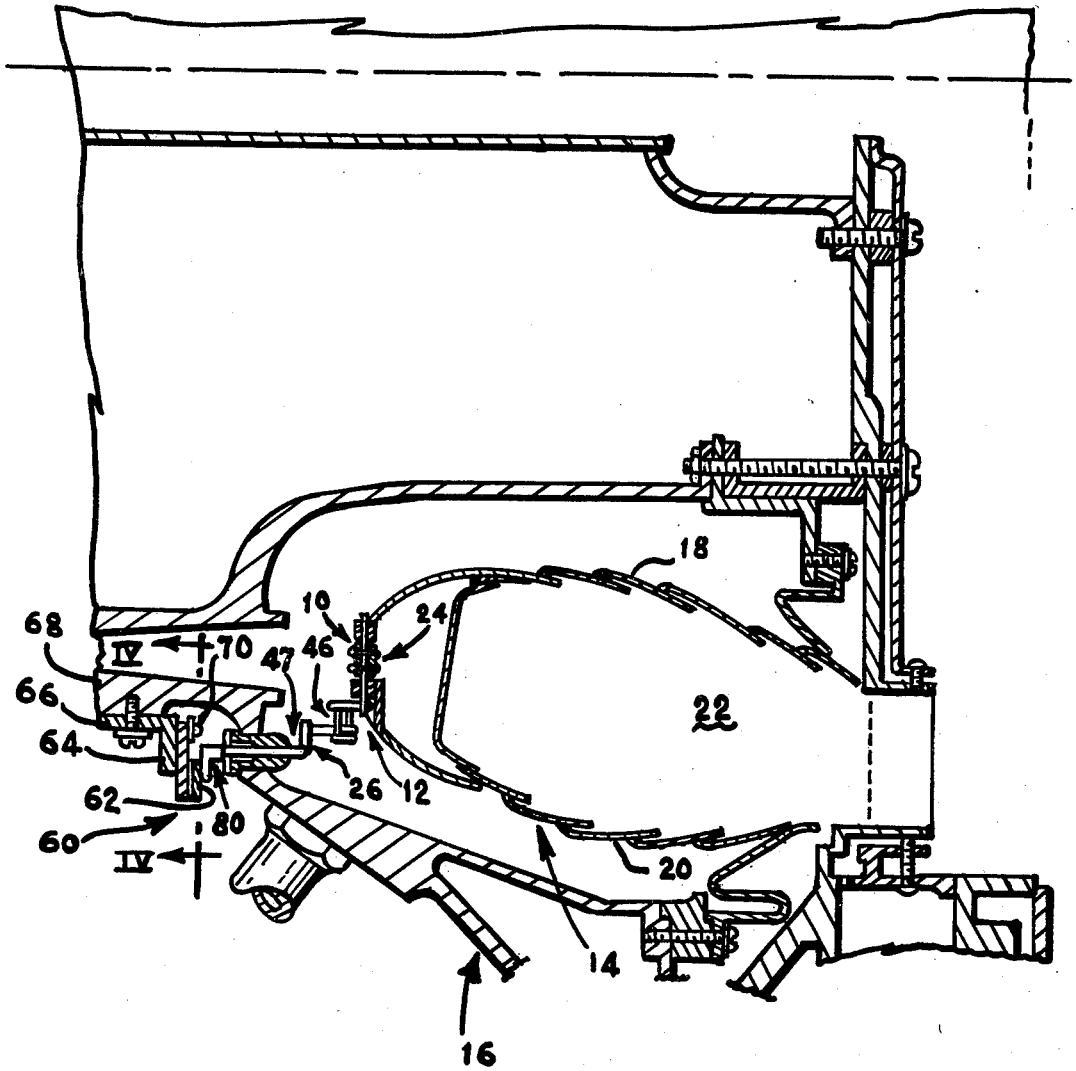
FIG. 1 is a side elevational view, shown partly in cross section, of the variable inlet vane assembly of this invention in place at the cowl inlet of a combustor which is shown in segmented fashion.

Reference is now made to FIG. 1 of the drawing which illustrates in a cross sectional side elevational view the variable inlet vane assembly 10 of this invention in place within the cowl inlet area 12 of a typical combustor 14 of the type suitable for use in a gas turbine engine 16. Since this invention is directed to the inlet area 12 of combustor 14 only those elements of gas turbine engine 16 which are relevant to the variable inlet vane assembly 10 of the instant invention will be set out with specificity.

For example, combustor 14 is of a generally annular configuration and is made up of an inner liner 18 and an outer liner 20 which are capable of accommodating thermal radial and axial growth during gas turbine operation. Liners 18 and 20 define a hollow annular chamber which is more commonly referred to as the combustion chamber 22. A controlled amount of both fuel and air enter combustion chamber 22 by way of the cowl inlet area 12.

As pointed out hereinabove a major problem which has ensued in gas turbine operation comes about as a result of the relight capability in advanced high temperature-rise combustors. In order to alleviate this problem, this invention provides variable inlet vane assembly 10 which is incorporated in the cowl inlet area 12 of combustor 14.

More particularly, variable vane assembly 10 of this invention includes a set of control vanes 24 more clearly depicted in FIGS. 2 and 3 of the drawing which circumscribe in an annular fashion the inlet cowl area 12. Since vane assembly 10 of this invention is made up of a plurality of control vanes 24 and associated control components, and since each of these vanes 24 and their associated components are identical in construction, for purposes of ease of understanding of this invention the following description will refer to only one such control vane 25 and control components. It should be realized, however, that in some instances the following description will relate to more than one such vane 24, but in those instances all identical elements will be referred to by the same reference numerals.

As clearly illustrated in FIGS. 2 and 3 of the drawing each vane 24 is located within an elongated opening 28 of preselected size situated annularly about the cowl inlet area 12 of combustor 14. In addition, suitable openings 30 are disposed between adjacent vanes 24 so that conventional fuel injectors (not shown) can be located therein. By appropriate control of vanes 24 in a manner set forth in detail hereinbelow, vane assembly 10 within cowl inlet area 12 permits a highly controlled air flow therethrough to combustion chamber 22.

As shown in FIGS. 2 and 3 of the drawing each vane 24 may be constructed in the form of a pair of plates 32 and 34 which are secured slightly off from the mid point thereof by means of any suitable securing elements, such as rivets 36 to a support shaft 38. As can be seen from the drawing each of the vanes 24 rotate with shaft 38. It should be noted, however, that the construction of individual vanes 24 may vary within the scope of this invention by, for example, being formed of one element having a hub located slightly off-center from the mid point thereof. The use of the off-center location of shaft 38 generates an aerodynamic load on vane 24, thus minimizing vane flutter as the vanes are rotated. In addition, this feature reduces wear on the bearing surfaces of the vane support shaft 38.

Each vane support shaft 38 is rotatably mounted within a pair of mounts 40 and 42 which are fixedly secured by conventional securing means to the combustor cowl inlet control area 12. Therefore, each vane 24 along with shaft 38 is capable of rotation within mounts 40 and 42. Rotation of vanes 24 is accomplished by means of the associated actuation system 26 operably connected to each vane 24.

More specifically, actuation system 26 is made up of a crank mechanism 46 and an actuator 47, with the outboard end of each shaft 38 being fixedly attached to crank mechanism 46 as clearly illustrated in FIGS. 2 and 3 of the drawing. Crank mechanism 46 is made up of a crank 48 fixedly secured at one end thereof to shaft 38 and aligned substantially perpendicular thereto. Two connecting pins 50 and 52 are mounted at one end thereof perpendicular to crank 48 allowing for a space therebetween and terminating at the other end thereof in a cover plate 54. The crank 48, pins 50 and 52, and cover plate 54, form a box assembly that is slidably engaged by actuator 47.

Actuator 47 includes a drive crank 56 which is free to slide within the box assembly between pins 50 and 52. Depending upon the desired direction of rotation of vane 24, drive crank 56 presses against one of the connecting pins 50 or 52 and, thus, moves vane 24 in the appropriate direction. As a result of this sliding arrangement between drive crank 56 and crank mechanism 46 thermal growth of combustor 14 in either the axial or radial direction can be easily accommodated by this invention.

To prevent binding between the components of actuation system 26 from taking place, crank mechanism 46 allows for thermal growth while maintaining the correct amount of area-variability to insure complete opening and closing of the vanes 24 during all operating conditions. In addition, the sliding interface surfaces between drive crank 56 and pins 50 and 52 are either hardened or have a special coating thereon in order to resist wear.

Figure 4:
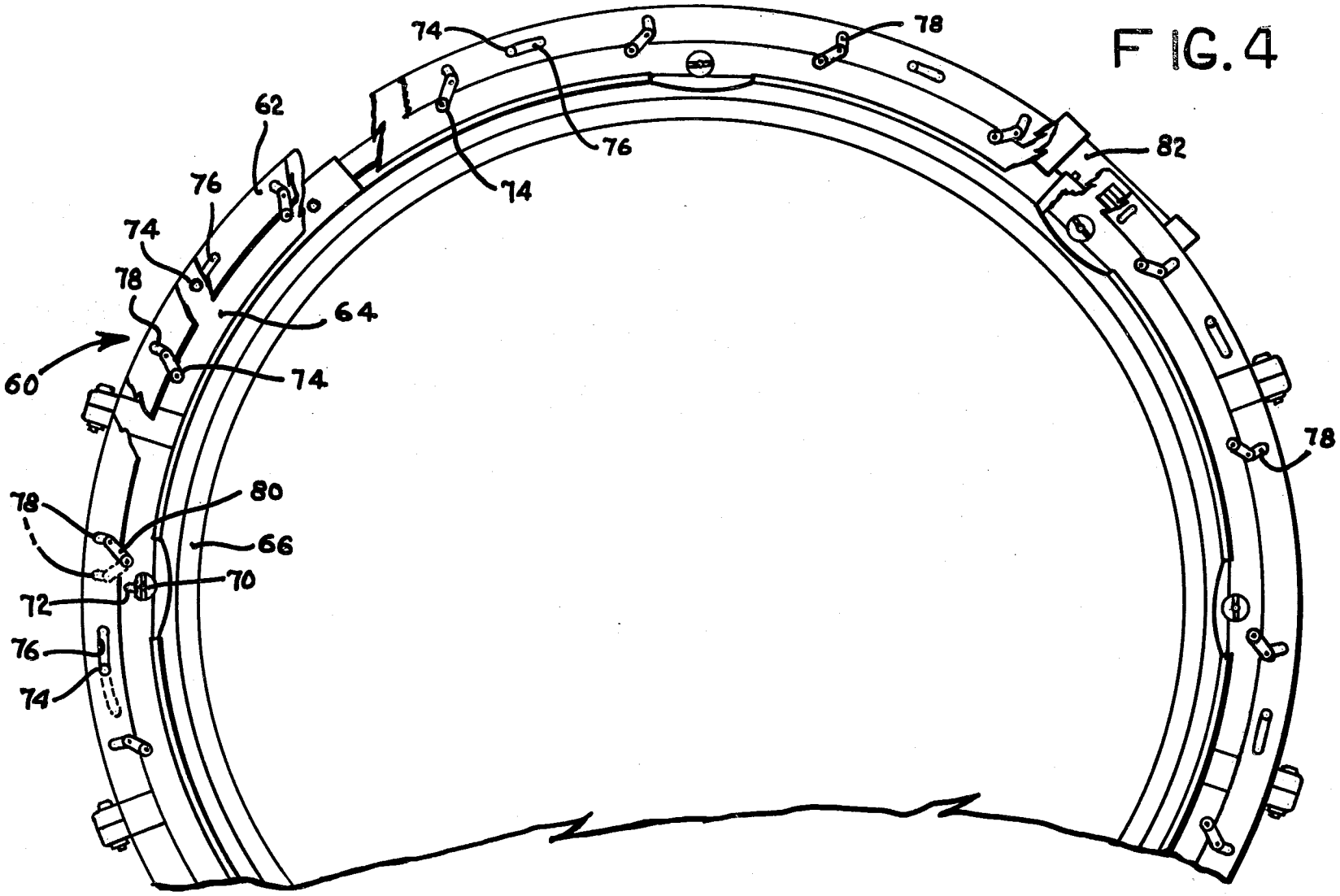
FIG. 4 is a front view of a synchronizing ring which can be used with the variable inlet vane assembly of this invention taken along line IV—IV of FIG. 1 and shown in segmented fashion.

Synchronous movement of all the vanes 24 of the variable inlet vane assembly 10 of this invention takes place as a result of the interconnection of actuator 47 to a synchronizing ring assembly 60 illustrated in cross section in FIG. 1 and shown more specifically in FIG. 4 of the drawing. Since a variety of synchronizing ring assemblies can be used with this invention only a brief description will be given below of a typical synchronizing ring assembly 60 adaptable for use with this invention. In this manner one can clearly understand, how, in fact, all vanes 24 of vane assembly 10 of this invention can be operated simultaneously and in a synchronous fashion.

As illustrated in FIGS. 1 and 4 of the drawing, synchronizing ring assembly 60 includes a movable sync ring 62, a fixed mounting ring 64 and a plurality of supporting brackets 66 which are fixedly attached to the outer diffuser case 68 of turbine engine 16. More specifically, fixed mounting ring 64 is secured to support brackets 66 by means of pins 70 which pass through radially elongated slots 72 in mounting ring 64. These elongated slots 72, one of which is illustrated in FIG. 4 of the drawing, allow for the thermal growth of the ring without inducing stresses in or along mounting ring 64. Movable sync ring 62 attaches to mounting ring 64 by a plurality of guide bars 74 which may be in the form of shouldered, high-strength bolts capable of allowing slots 76 in sync ring 62 to slide thereagainst. Each drive crank 56 of each actuator 47 engages a radially elongated slot 78 in the sync ring 62 by means of an elongated crank arm 80 as illustrated in FIGS. 1 and 4 of the drawing.

Movement of sync ring 62 is accomplished by means of any suitable power source such as an air cylinder 82 operating from a high-pressure air supply (not shown). It is preferable that air cylinder 82 provide only a two-position actuation, which enables the actuator system 26 to provide a two-position movement of vanes 24. It should be realized, however, that a multi-position vane can also be utilized with this invention if so desired.

Indication of degree of movement can be provided electrically with limit switches or visually with fiber optic techniques which look directly at vanes 24 as they rotate. By providing a plurality of vanes 24 in the cowl inlet area 12 of combustor 14 controlled regulation of the flow of air into combustion chamber 22 can be easily accomplished. In addition, this invention allows for regulation of air flow into combustion chamber 22 in a highly reliable and effective manner since no interference by thermal growth of the combustor 14 will effect the vane operation.

MODE OF OPERATION

As is clearly shown in FIGS. 1 and 3 of the drawing in particular, a plurality of vanes 24 annularly circumscribe cowl inlet area 12 of combustor 14. By the appropriate actuation of sync ring 62 rotation of drive crank 56 of actuator 47 takes place as indicated by the arrow of FIG. 3 of the drawing. Rotation of drive crank 56 causes movement of crank mechanism 46 to take place and therefore subsequent rotation of shaft 38. Vanes 24 which are secured to shaft 38 therefore also rotate accordingly.

As described above, this rotation may be between two selected positions of open or closed, or to a variety of intermediate positions if so desired. Any thermal radial or axial growth of combustor 14 will not affect the operation of the variable inlet vane assembly 10 of this invention since the makeup of actuator system 26 will accommodate any such growth of combustor 14. This invention will therefore reliably regulate air flow into combustion chamber 22 and will do so in a light weight, cost efficient manner.

Although this invention has been described with reference to a particular embodiment, it will be understood that this invention is also capable of further and other embodiments within the spirit and scope of the appended claims.

I claim:

1. A variable inlet assembly for use within an inlet area of a combustor comprising:

means operably associated with said inlet area of said combustor for defining an opening therein in order to allow gas to flow into said combustor;

means located within said opening for controlling the amount of said gas flowing therethrough, said gas flow control means including a plurality of spaced-apart vanes and means operably connected to each of said vanes for rotatably mounting each of said vanes within said opening within said inlet area of said combustor, said means for mounting each of said vanes including a pair of mounts and a shaft rotatably mounted at both ends thereof within said mounts, said shaft being fixedly secured to said vane at a slight off-center position with respect thereto;

means operably connected to said gas flow control means for moving said vanes to a plurality of positions, said gas flow control moving means including a plurality of crank mechanisms, each of said crank mechanisms having a crank fixedly secured at one end thereof to said shaft, a pair of connecting pins extending substantially perpendicular to said crank forming a space therebetween, and a drive crank, said drive crank having one end thereof within said space and capable of engaging said pair of pins and having the other end operably connected to said synchronous moving means; and means operably connected to the other end of said drive crank for synchronously moving all of said vanes within said opening;

whereby the control of gas flowing into said combustor significantly improves the relight capability of said combustor.

2. A variable inlet assembly for use within an inlet area of a combustor as defined in claim 1 wherein said opening is in the form of an annular-shaped opening.

3. A variable inlet assembly for use within an inlet area of a combustor as defined in claim 2 wherein said pair of pins are further held in spaced-apart relationship by a cover plate secured thereto.

4. A variable inlet assembly for use within an inlet area of a combustor as defined in claim 3 wherein each of said vanes are made of a pair of juxtaposed plates fixedly secured to said shaft.

5. A variable inlet assembly for use within an inlet area of a combustor as defined in claim 4 wherein said gas flowing through said variable inlet assembly is air.

* * * * *